US011653717B2

(12) United States Patent
Kajiwara et al.

(10) Patent No.: US 11,653,717 B2
(45) Date of Patent: May 23, 2023

(54) SHOES

(71) Applicant: MIZUNO CORPORATION, Osaka (JP)

(72) Inventors: Yo Kajiwara, Osaka (JP); Kazuya Tajima, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 88 days.

(21) Appl. No.: 17/193,684

(22) Filed: Mar. 5, 2021

(65) Prior Publication Data

US 2021/0298422 A1 Sep. 30, 2021

(30) Foreign Application Priority Data

Mar. 25, 2020 (JP) ..... JP2020-054993

(51) Int. Cl.

| | |
|---|---|
| ***A43B 7/06*** | (2006.01) |
| ***A43B 23/02*** | (2006.01) |
| ***A43B 7/08*** | (2022.01) |
| ***A43B 7/12*** | (2006.01) |
| ***A43B 13/14*** | (2006.01) |

(Continued)

(52) U.S. Cl.

CPC ..... *A43B 23/022* (2013.01); *A43B 7/06* (2013.01); *A43B 7/082* (2013.01); *A43B 7/085* (2013.01); *A43B 7/125* (2013.01); *A43B 13/14* (2013.01); *A43B 13/386* (2013.01); *A43B 23/0245* (2013.01); *D04B 21/16* (2013.01); *D10B 2403/011* (2013.01); *D10B 2403/0221* (2013.01); *D10B 2501/043* (2013.01)

(58) Field of Classification Search

CPC ..... A43B 7/06; A43B 7/082; A43B 7/085
USPC ..... 36/3 R, 3 A
See application file for complete search history.

(56) References Cited

U.S. PATENT DOCUMENTS 5,014,363 A * 5/1991 Hubner ..... A41D 19/0079 2/200.1
8,959,959 B1 * 2/2015 Podhajny ..... A43B 1/04 36/47

(Continued)

FOREIGN PATENT DOCUMENTS

DE 10 2015 205 751 10/2016
DE 10 2016 201 973 8/2017

(Continued)

*Primary Examiner* — Marie D Bays
(74) *Attorney, Agent, or Firm* — Hamre, Schumann, Mueller & Larson, P.C.

(57) ABSTRACT

The present invention relates to a shoe including an upper, the upper including an instep cover that covers the instep of a foot. The instep cover includes an instep cover body and a tongue. Two or more protrusions that are configured to extend in use from the instep cover body toward the foot are located at least in a region between the MP joint and the talus in a side portion of the instep cover body. The protrusions are made of embroidery. The protrusions have a height of 0.5 mm or more, a width of 2 mm or more, and a length of 2 mm or more. A distance between each pair of the adjacent protrusions is 2 mm or more in part of the region. The shoe of the present invention includes the upper that improves the heat dissipation properties without impairing the contact between the foot and the shoe.

12 Claims, 14 Drawing Sheets

(51) Int. Cl.
*D04B 21/16* (2006.01)
*A43B 13/38* (2006.01)

(56) References Cited

U.S. PATENT DOCUMENTS

2004/0111918 A1* 6/2004 Van Noy ..... A43B 7/125 36/3 R
2007/0271821 A1 11/2007 Meschter
2010/0037483 A1 2/2010 Mechter et al.
2010/0175276 A1 7/2010 Dojan et al.
2012/0055044 A1* 3/2012 Dojan ..... A43B 23/0245 36/83
2014/0237861 A1* 8/2014 Podhajny ..... D04B 15/56 66/170
2015/0237948 A1* 8/2015 Mallen ..... A43B 1/04 66/170
2015/0272274 A1* 10/2015 Berns ..... A43B 7/14 36/84
2016/0135543 A1* 5/2016 Anceresi ..... A43B 23/0235 36/45
2016/0286898 A1 10/2016 Manz et al.
2017/0150783 A1* 6/2017 Polegato Moretti ... A43B 7/082
2017/0354202 A1* 12/2017 Cai ..... D05C 5/04
2018/0338563 A1* 11/2018 Moretti Polegato .... B32B 5/026
2018/0360156 A1* 12/2018 Whiteman ..... A43B 1/04
2019/0289963 A1* 9/2019 Iuchi ..... A43B 13/38
2020/0071869 A1* 3/2020 Lu ..... D05C 17/00
2020/0347524 A1* 11/2020 Yao ..... D02G 3/06
2022/0142293 A1* 5/2022 Tapper ..... A61N 5/0622

FOREIGN PATENT DOCUMENTS

EP 2 957 186 12/2015
EP 3 075 277 10/2016
EP 3 545 784 10/2019
JP 2012-533404 12/2012
JP 2016-198481 12/2016
JP 2017-518121 7/2017
WO 2007/140055 12/2007
WO 2011/011176 1/2011
WO 2015/193385 12/2015
WO 2018/236346 12/2018

* cited by examiner

SHOES

BACKGROUND OF THE INVENTION

1. Field of the Invention

The present invention relates to a shoe with improved heat dissipation properties. Specifically, the present invention relates to a shoe including an upper with improved heat dissipation properties.

2. Description of Related Art

Shoes are required to have heat dissipation properties as a basic function that is necessary for comfort in everyday life or during exercise (e.g., running, marathon, and other sports). From the viewpoint of the heat dissipation properties, most parts of a shoe upper are often made of breathable upper materials. In many cases, the back side of the upper has a structure without seams or unevenness of materials, taking into account the contact between the foot and the shoe. However, when the back side of the upper is free of unevenness, the upper will be in close contact with the foot. Therefore, even if the breathable upper materials are used, convection of gas such as sweat vapor is not likely to occur within the shoes, and the heat dissipation properties may be reduced. Moreover, it is not possible to accelerate the evaporation of sweat from the feet or socks when the convection of gas such as sweat vapor in the shoes is less active. This may result in foot discomfort, the development of blisters and swelling, poor performance, etc. Patent Document 1 proposes to form preferential passages for the sweat that moves away from the foot of the user toward the external edge of the upper of a shoe. The preferential passages are defined by a series of channels that are produced by a series of parallel ridges.

Patent Document 1: JP 2017-518121 A

SUMMARY OF THE INVENTION

However, in Patent Document 1, the ridges and the channels are formed by three-dimensional fabrics. For this reason, the breathability of the upper needs to be improved further.

To solve the above problem, the present invention provides a shoe including an upper that improves the heat dissipation properties without impairing the contact between the foot and the shoe.

The present invention relates to a shoe including an upper, the upper including an instep cover that covers the instep of a foot. The instep cover includes an instep cover body and a tongue. Two or more protrusions that are configured to extend in use from the instep cover body toward the foot are located at least in a region between the MP joint and the talus in a side portion of the instep cover body. The protrusions are made of embroidery. The protrusions have a height of 0.5 mm or more, a width of 2 mm or more, and a length of 2 mm or more. A distance between each pair of adjacent protrusions is 2 mm or more in part of the region.

The present invention can provide a shoe including an upper that improves the heat dissipation properties without impairing the contact between the foot and the shoe.

DETAILED DESCRIPTION OF THE INVENTION

The present inventors conducted many studies on the upper of a shoe to improve the heat dissipation properties without impairing the contact between the foot and the shoe. As a result, the present inventors found that it was possible to improve the heat dissipation properties and also to maintain comfortable contact between the foot and the shoe when the upper satisfied the following conditions: (i) two or more protrusions that are made of embroidery and configured to extend in use from the instep cover body toward the foot (also referred to as "protrusions facing the foot" in the following) are located at least in a region between the MP joint and the talus in a side portion of the instep cover body; (ii) the protrusions facing the foot have a height of 0.5 mm or more, a width of 2 mm or more, and a length of 2 mm or more; and (iii) a distance between each pair of the adjacent protrusions is 2 mm or more in part of the region.

Figure 1:
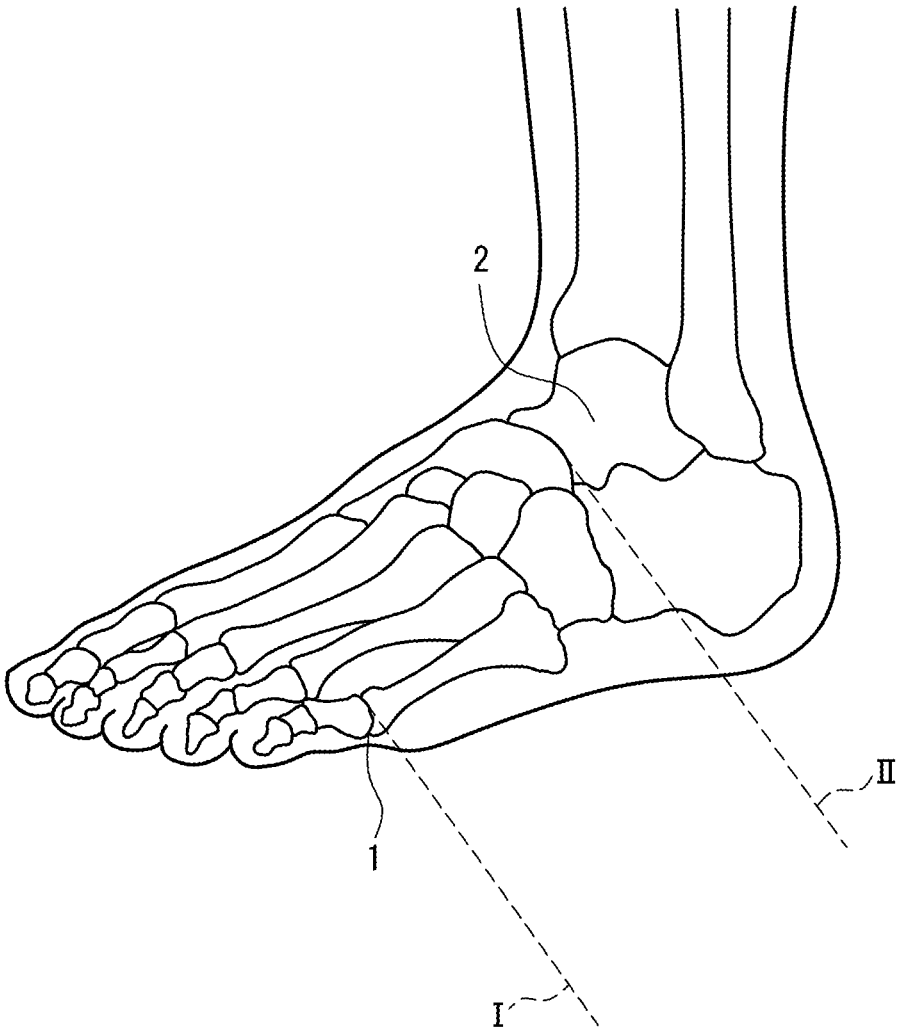
FIG. 1 is a schematic perspective view of a foot when viewed from the outside.

Embroidery has been conventionally applied to the upper of a shoe and mainly served as a means for controlling, e.g., the tensile properties and stretchability of a base layer of the upper (see, e.g., JP 2012-533404 A, JP 2016-198481 A, and WO 2018/236346). The present invention uses embroidery to form two or more protrusions that extend from the instep cover body toward the foot at least in the region between the MP joint and the talus in the side portion of the instep cover body. The two or more protrusions have a predetermined size and a predetermined arrangement. With this configuration, the present invention can surprisingly improve the heat dissipation properties while maintaining comfortable contact between the foot and the shoe. In general shoes, the upper substantially adheres to the foot in the region between the MP joint 1 and the talus 2 (i.e., from the MP joint to the distal end of the talus), indicated by a broken line I and a broken line II shown in FIG. 1. Therefore, convection of gas such as sweat vapor is not likely to occur within the general shoes, and the heat dissipation properties are reduced. On the other hand, in the present invention, two or more protrusions having a predetermined size and a predetermined arrangement are formed with embroidery and extend from the instep cover body toward the foot in the above region between the MP joint and the talus. Due to the presence of the protrusions, a space can be created between the foot and the instep cover body when the shoe is worn. Thus, convection of gas such as sweat vapor in the shoes may become active, and the heat dissipation properties may be improved. In particular, the use of embroidery can increase the degree of freedom in the arrangement of the protrusions, so that the protrusions of any shape and any pitch can be located in any place and any direction. Moreover, the size (e.g., height or the like) of the protrusions can be set as desired, and the space can be appropriately created between the foot and the instep cover body. The formation of the protrusions using embroidery does not impair the contact between the foot and the shoe and also has a reinforcing effect.

Figure 2:
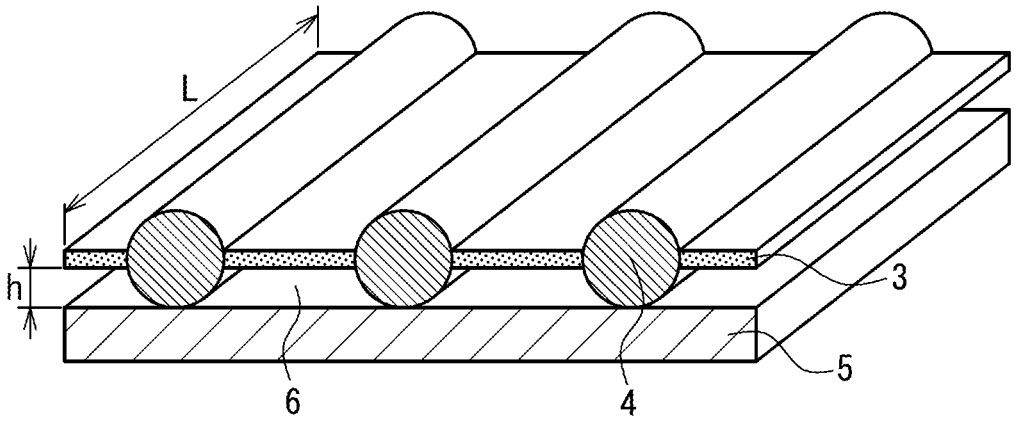
FIG. 2 is a schematic perspective view for explaining the heat dissipation properties of an upper in an example of the present invention.
Figure 3:
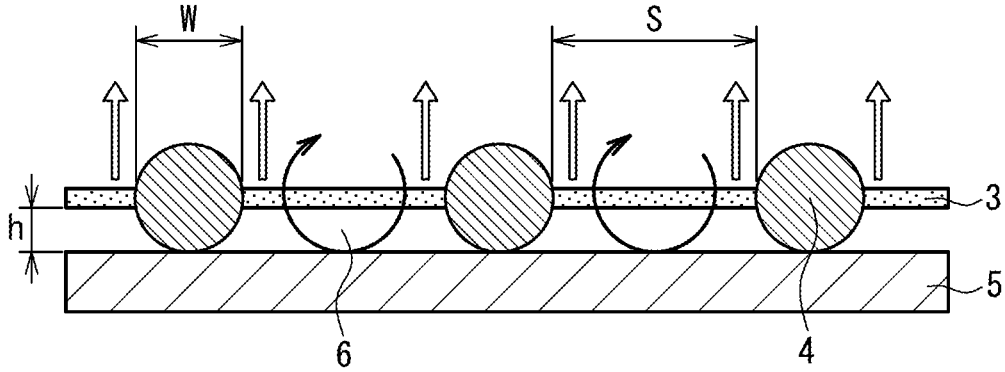
FIG. 3 is a schematic cross-sectional view for explaining the heat dissipation properties of the upper.
Figure 4:
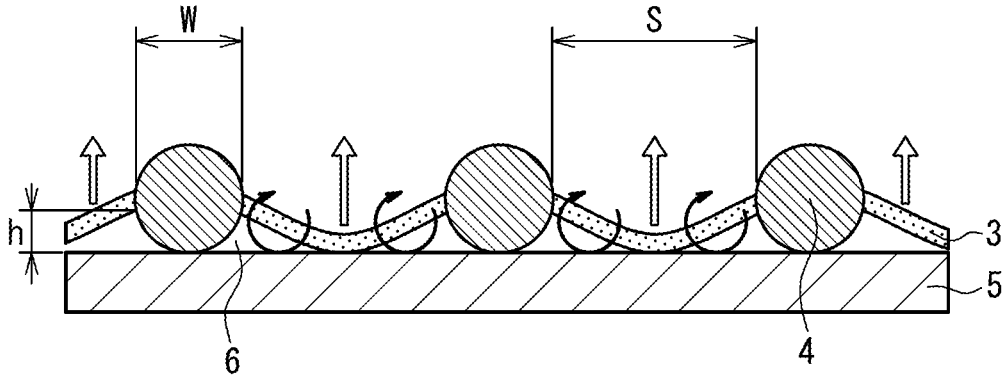
FIG. 4 is a schematic cross-sectional view for explaining the heat dissipation properties of an upper in another example of the present invention.

FIG. 2 is a schematic perspective view for explaining the heat dissipation properties of an upper in an example of the present invention. FIG. 3 is a schematic cross-sectional view for explaining the heat dissipation properties of the upper. FIGS. 2 and 3 illustrate that the instep cover body is completely separated from the foot between the adjacent protrusions facing the foot. FIG. 4 is a schematic cross-sectional view for explaining the heat dissipation properties of an upper in another example of the present invention. FIG. 4 illustrates that the instep cover body is partially separated from the foot between the adjacent protrusions facing the foot. As shown in FIGS. 2 to 4, since two or more protrusions 4 with a predetermined size extend from the instep cover body 3 toward the foot 5, a space 6 can be created between the foot 5 and the instep cover body 3 when the shoe is worn. Thus, convection of gas such as sweat vapor in the shoes becomes active, and the heat dissipation properties can be improved. If the height h of the protrusions 4 facing the foot is less than 0.5 mm, a space will not be created between the foot 5 and the instep cover body 3. If the width W of the protrusions 4 facing the foot is less than 0.5 mm, a space will not be created between the foot 5 and the instep cover body 3. If the length L of the protrusions 4 facing the foot is less than 2 mm, a space will not be created between the foot 5 and the instep cover body 3. If there is no portion in which a distance S between each pair of the adjacent protrusions 4 is 2 mm or more, a space will not be created between the foot 5 and the instep cover body 3. The length and the width of the protrusions facing the foot are the size in the longitudinal direction and the size in the width direction, respectively.

The protrusions facing the foot are not particularly limited, and may have a height of preferably 0.7 mm or more, and more preferably 0.9 mm or more, e.g., from the viewpoint of improving the heat dissipation properties. Furthermore, the protrusions facing the foot are not particularly limited, and may have a height of preferably 10 mm or less, more preferably 8 mm or less, and further preferably 6 mm or less, e.g., from the viewpoint of facilitating comfortable contact between the foot and the shoe. The individual protrusions facing the foot may have the same height or different heights from each other. More specifically, the height of the protrusions facing the foot is preferably 0.5 mm or more and 10 mm or less, more preferably 0.6 mm or more and 8 mm or less, and further preferably 0.9 mm or more and 6 mm or less. The height of the protrusions facing the foot is measured under no-load conditions. Specifically, a space between a test stand and the instep cover body is observed by a microscope (digital microscope VHX-100F), and the height of the space is measured and defined as the height of the protrusions facing the foot.

The protrusions facing the foot are not particularly limited, and may have a width of preferably 4 mm or more, and more preferably 6 mm or more, e.g., from the viewpoint of facilitating comfortable contact between the foot and the shoe. Furthermore, the protrusions facing the foot are not particularly limited, and may have a width of preferably 30 mm or less, more preferably 25 mm or less, and further preferably 20 mm or less, e.g., from the viewpoint of ease of improvement in the heat dissipation properties. The individual protrusions facing the foot may have the same width or different widths from each other. More specifically, the width of the protrusions facing the foot is preferably 2 mm or more and 30 mm or less, more preferably 4 mm or more and 25 mm or less, and further preferably 6 mm or more and 20 mm or less.

The protrusions facing the foot are not particularly limited, and may have a length of preferably 5 mm or more, and more preferably 10 mm or more, e.g., from the viewpoint of ease of improvement in the heat dissipation properties. Furthermore, the protrusions facing the foot are not particularly limited, and may have a length of preferably 80 mm or less, more preferably 60 mm or less, and further preferably 50 mm or less, e.g., from the viewpoint of facilitating comfortable contact between the foot and the shoe. The individual protrusions facing the foot may have the same length or different lengths from each other. More specifically, the length of the protrusions facing the foot is preferably 2 mm or more and 80 mm or less, more preferably 5 mm or more and 60 mm or less, and further preferably 10 mm or more and 50 mm or less.

The distance between the adjacent protrusions facing the foot is not particularly limited. For example, from the viewpoint of ease of improvement in the heat dissipation properties, it is preferable that the distance between some of the adjacent protrusions is 2 mm or more and 85 mm or less, and it is more preferable that the distance between some of the adjacent protrusions is 3 mm or more and 20 mm or less. Furthermore, from the viewpoint of ease of improvement in the heat dissipation properties, it is further preferable that the distance between all the adjacent protrusions is 2 mm or more and 85 mm or less, and it is particularly preferable that the distance between all the adjacent protrusions is 3 mm or more and 20 mm or less. The distance between the adjacent protrusions may be constant or changed along the entire length of the individual protrusions facing the foot.

Figure 16:
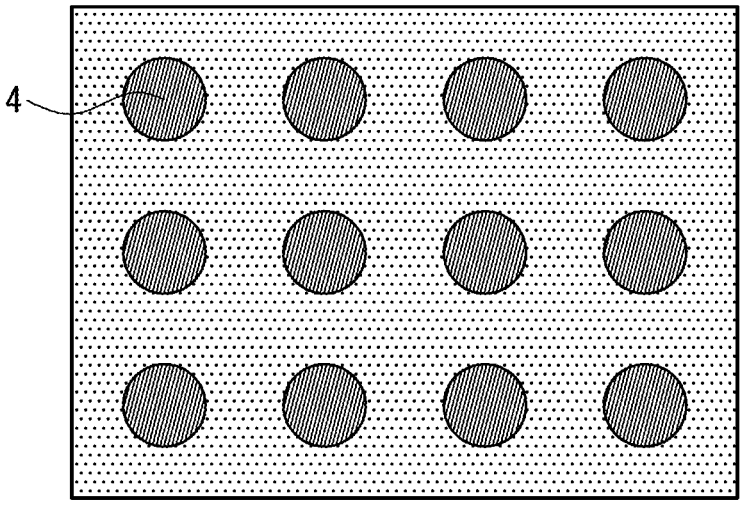
FIG. 16 is a schematic plan view illustrating an example of protrusions located on the side of an upper facing the foot.
Figure 17:
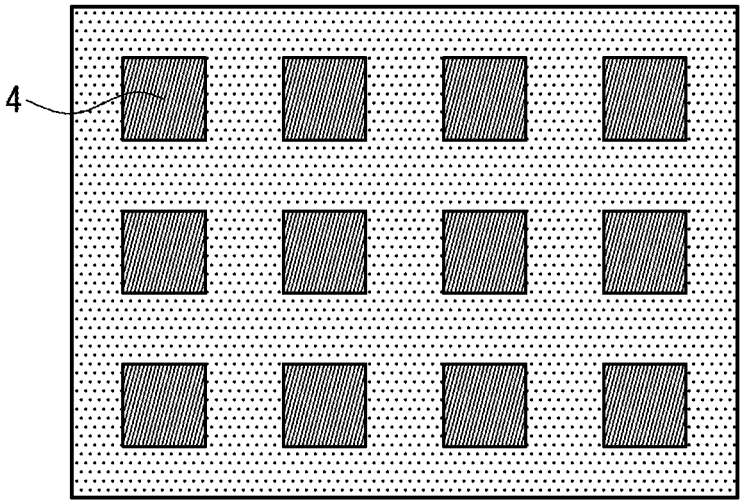
FIG. 17 is a schematic plan view illustrating an example of protrusions located on the side of an upper facing the foot.

The protrusions facing the foot are elongated in FIG. 2, but may have any shape that meets the above dimensions. For example, the protrusions facing the foot may be short. For example, the protrusions 4 facing the foot may be circular in plan view as shown in FIG. 16, quadrilateral (square etc.) in plan view as shown in FIG. 17, or of any other polygonal shape in plan view. When the protrusions facing the foot are circular in plan view, both the length and the width of each protrusion correspond to the diameter of the circle.

The protrusions facing the foot are not particularly limited, and may be made of at least one type of embroidery stitches selected from the group consisting of a satin stitch and a tatami stitch (fill stitch). The protrusions may extend not only toward the foot, but also toward the opposite side of the instep cover body from the foot.

The protrusions facing the foot may be composed of either embroidery threads alone or embroidery threads and a base material. The embroidery threads are not particularly limited, and may be, e.g., spun yarns or filament yarns. The base material is not particularly limited, and may be, e.g., a reinforcing material such as a reinforced nonwoven fabric usually used for embroidery.

In the region between the MP joint and the talus in the side portion of the instep cover body, the area ratio of the protrusions facing the foot is not particularly limited, and is preferably 1% or more and 50% or less, more preferably 5% or more and 45% or less, and further preferably 10% or more and 40% or less relative to the total area of the region between the MP joint and the talus in the side portion of the instep cover body from the viewpoint of ensuring both the heat dissipation properties and the contact between the foot and the shoe. The area ratio of the protrusions facing the foot can be calculated by the following formula (1):

$$\text{Area ratio of protrusions facing foot (\%)} = Ca/Ta \times 100 \quad (1)$$

where Ta represents the total area of the region between the MP joint and the talus in the side portion of the instep cover body and Ca represents the total area of the protrusions facing the foot.

In the region between the MP joint and the talus in the side portion of the instep cover body, the air permeability of the portion including the protrusions facing the foot is not particularly limited, and is preferably 110 $cc/cm^2/sec$ or more, more preferably 130 $cc/cm^2/sec$ or more, and further preferably 150 $cc/cm^2/sec$ or more, as measured in accordance with the Frazier method, from the viewpoint of improving the heat dissipation properties.

In addition to the region between the MP joint and the talus, other portions of the instep cover body may also include protrusions that are made of embroidery and extend toward the foot. Moreover, the instep cover body may have other embroidered portions that extend only toward the opposite side of the instep cover body from the foot.

The instep cover body is not particularly limited. From the viewpoint of improving the heat dissipation properties, the instep cover body is made of preferably a mesh fabric, more preferably a mesh fabric with an air permeability of 200 $cc/cm^2/sec$ or more, further preferably a mesh fabric with an air permeability of 250 $cc/cm^2/sec$ or more, and particularly preferably a mesh fabric with an air permeability of 300 $cc/cm^2/sec$ or more. In this case, the air permeability is measured in accordance with the Frazier method.

The mesh fabric is not particularly limited. Examples of the mesh fabric include warp knitted fabrics such as a single raschel fabric, a double raschel fabric, and a tricot fabric and weft knitted fabrics such as a plain knitted fabric and a circular knitted fabric. Through holes in the mesh fabric are not particularly limited, and may have a major axis of, e.g., 0.3 mm or more and 20 mm or less and a minor axis of, e.g., 0.3 mm or more and 20 mm or less. The major axis of a through hole means the length of the longest straight line connecting any two points on the perimeter of the through hole. The minor axis of the through hole means the length of the longest perpendicular line that is perpendicular to the major axis. The number of through holes in the mesh fabric is not particularly limited, and may be, e.g., 1 to 10000 per square inch.

The upper of a shoe is not particularly limited, and may further include members such as shoelace holes (also referred to as eyelets) in addition to the instep cover body and the tongue. The shoelace holes may be reinforced with, e.g., artificial leather. The upper may further include a sole cover that covers the whole sole of the foot. In this case, the upper has a bag-like shape with an opening for receiving the foot. This configuration further enhances the integration of the upper and the sole of the shoe. Different members of the upper may be made of either different materials or the same material. For example, the mesh fabric may be used for the sole cover and the tongue in terms of breathability and lightweight.

In the shoe, only the end portion of the tongue may be connected to the instep cover body. Alternatively, the tongue and the instep cover body may be joined to form a single unit. When the tongue and the instep cover body are joined together, the contact between the foot and the shoe can be more comfortable, and the fitting properties and the long-term wearability can also be improved. The tongue and the instep cover body may be joined as a single unit by sewing or preferably with the embroidery that covers the edge of the tongue and/or the instep cover body. This can improve the contact between the foot and the shoe, resulting in better fitting properties of the shoe with the instep of the foot.

In the shoe, the upper is attached to the sole. The method for attaching the upper to the sole is not particularly limited, and may be, e.g., a typical cemented construction method. The sole may be appropriately selected from general soles for shoes.

It is preferable that the tip, the heel, and the eyelets of the shoe are reinforced with artificial leather. The reinforcement of these members can maintain the shape and holding properties of the shoe. In this case, the heel does not need to be reinforced if a weight reduction of the shoe is truly required. Moreover, the surface of the upper of the shoe may be decorated as appropriate. The shoe may also have a shoelace.

Hereinafter, the present invention will be described in detail with reference to the drawings. In the drawings, the same components are denoted by the same reference numerals. The present invention is not limited to the following embodiments shown in the drawings.

Figure 5:
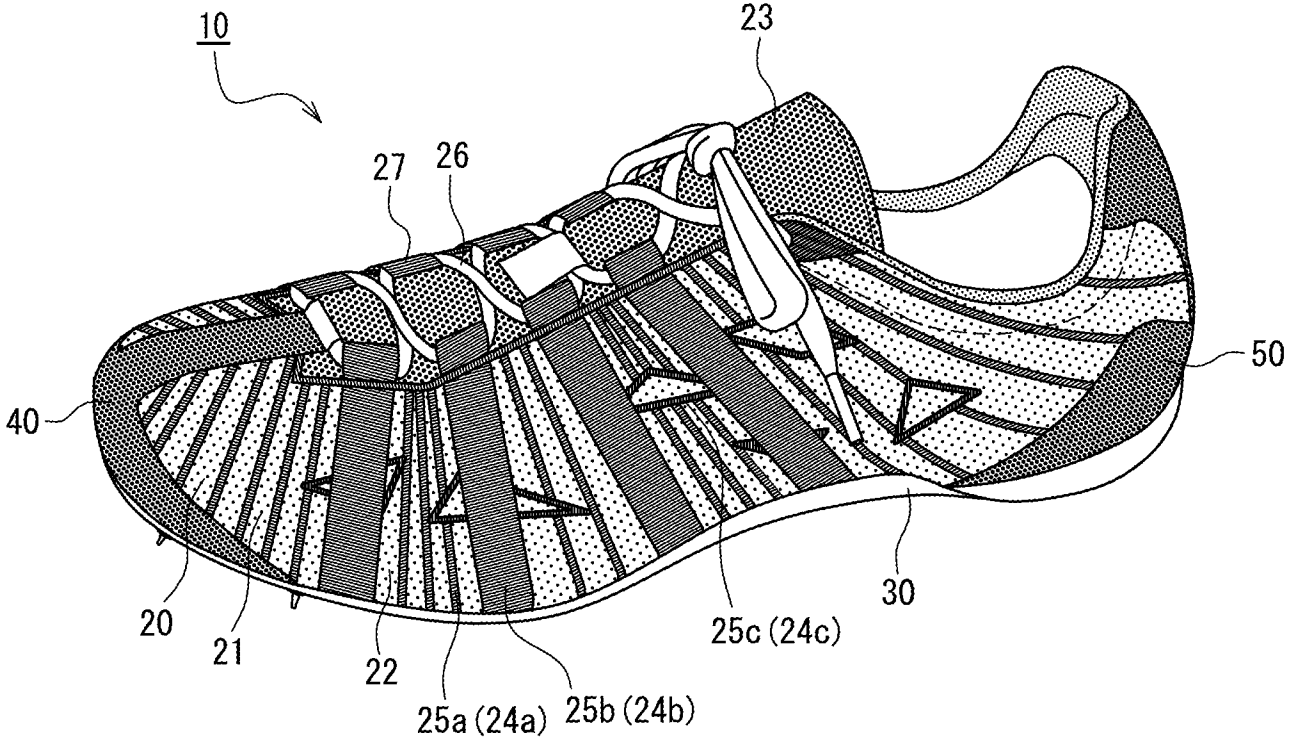
FIG. 5 is a schematic perspective view of a shoe (left foot) of an embodiment of the present invention.
Figure 6:
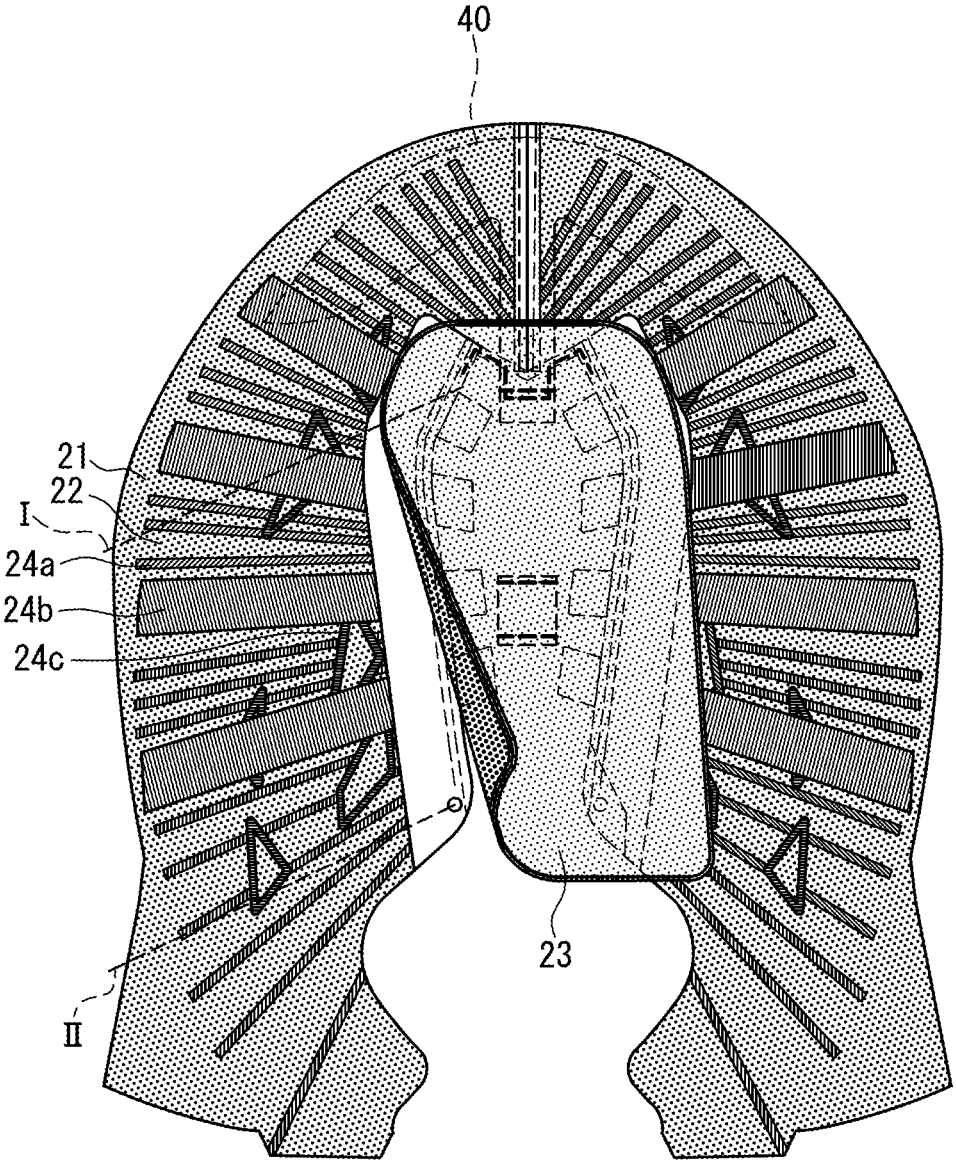
FIG. 6 is a schematic developed view illustrating the back side of an upper of the shoe (which faces the foot).
Figure 7:
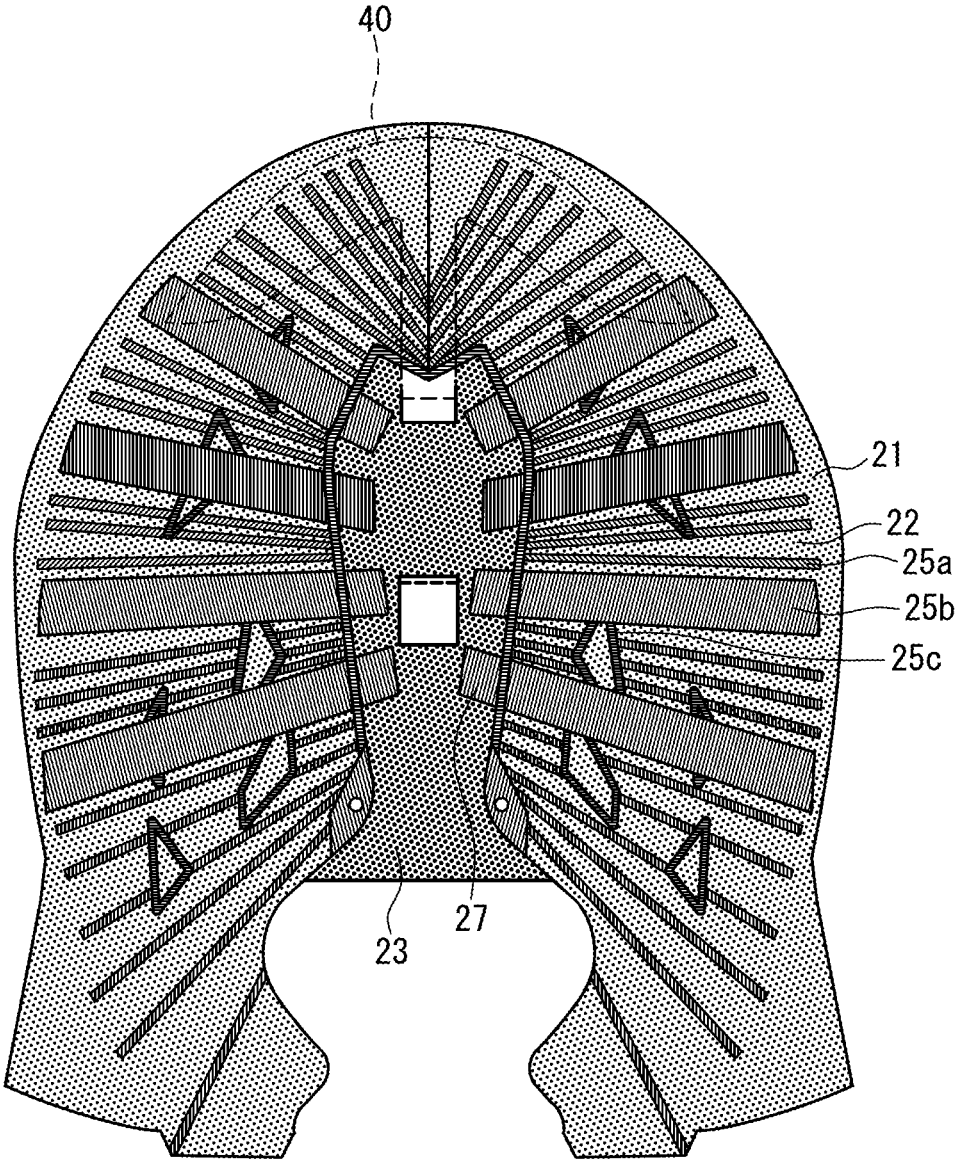
FIG. 7 is a schematic developed view illustrating the front side of the upper of the shoe (which faces away from the foot).

FIG. 5 is a schematic perspective view of a shoe (left foot) of an embodiment of the present invention. FIG. 6 is a schematic developed view illustrating the back side of an upper of the shoe (which faces the foot). FIG. 7 is a schematic developed view illustrating the front side of the upper of the shoe (which faces away from the foot). In this embodiment, a shoe 10 includes an upper 20 and a sole 30 to which the upper 20 is attached.

The upper 20 includes an instep cover 21 that covers the instep of the foot. The instep cover 21 includes an instep cover body 22 and a tongue 23. Only the end portion of the tongue 23 is connected to the instep cover body 22 by sewing.

A plurality of protrusions 24*a*, 24*b*, 24*c* are formed with embroidery on the side of the instep cover body 22 facing the foot. The embroidered protrusions 24*a*, 24*b*, 24*c* penetrate the instep cover body 22. Accordingly, a plurality of protrusions 25*a*, 25*b*, 25*c* corresponding to the protrusions 24*a*, 24*b*, 24*c*, respectively, are formed on the opposite side of the instep cover body 22 from the foot.

The protrusions 24*a*, 24*b*, 24*c* facing the foot are located at least in a region between the MP joint and the talus in a side portion of the instep cover body 22. The protrusions 24*a*, 24*b*, 24*c* have a height of 0.5 mm or more, a width of 2 mm or more, and a length of 2 mm or more. At least in the region between the MP joint and the talus in the side portion of the instep cover body 22, there is a portion in which a distance between each pair of the adjacent protrusions 24*a*, 24*b*, 24*c* is 2 mm or more. The protrusions 25*a*, 25*b*, 25*c* on the opposite side may have a height of 0.5 mm or more, a width of 2 mm or more, and a length of 2 mm or more.

The instep cover 21 also includes shoelace holes 27 through which a shoelace 26 passes. The shoe 10 may include a toe reinforcement 40 and a heel counter 50. The toe reinforcement 40 and the heel counter 50 may be made of, e.g., artificial leather.

Figure 8:
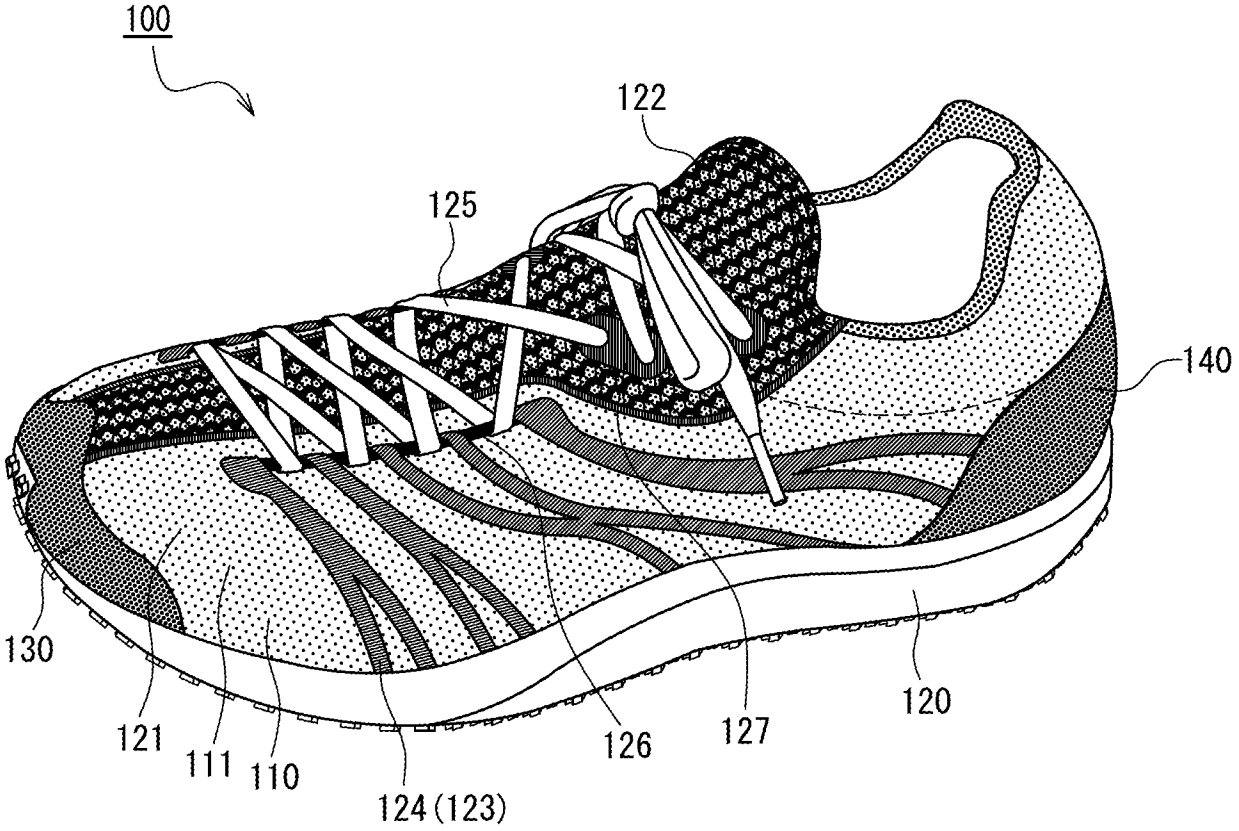
FIG. 8 is a schematic perspective view of a shoe (left foot) of an embodiment of the present invention.
Figure 9:
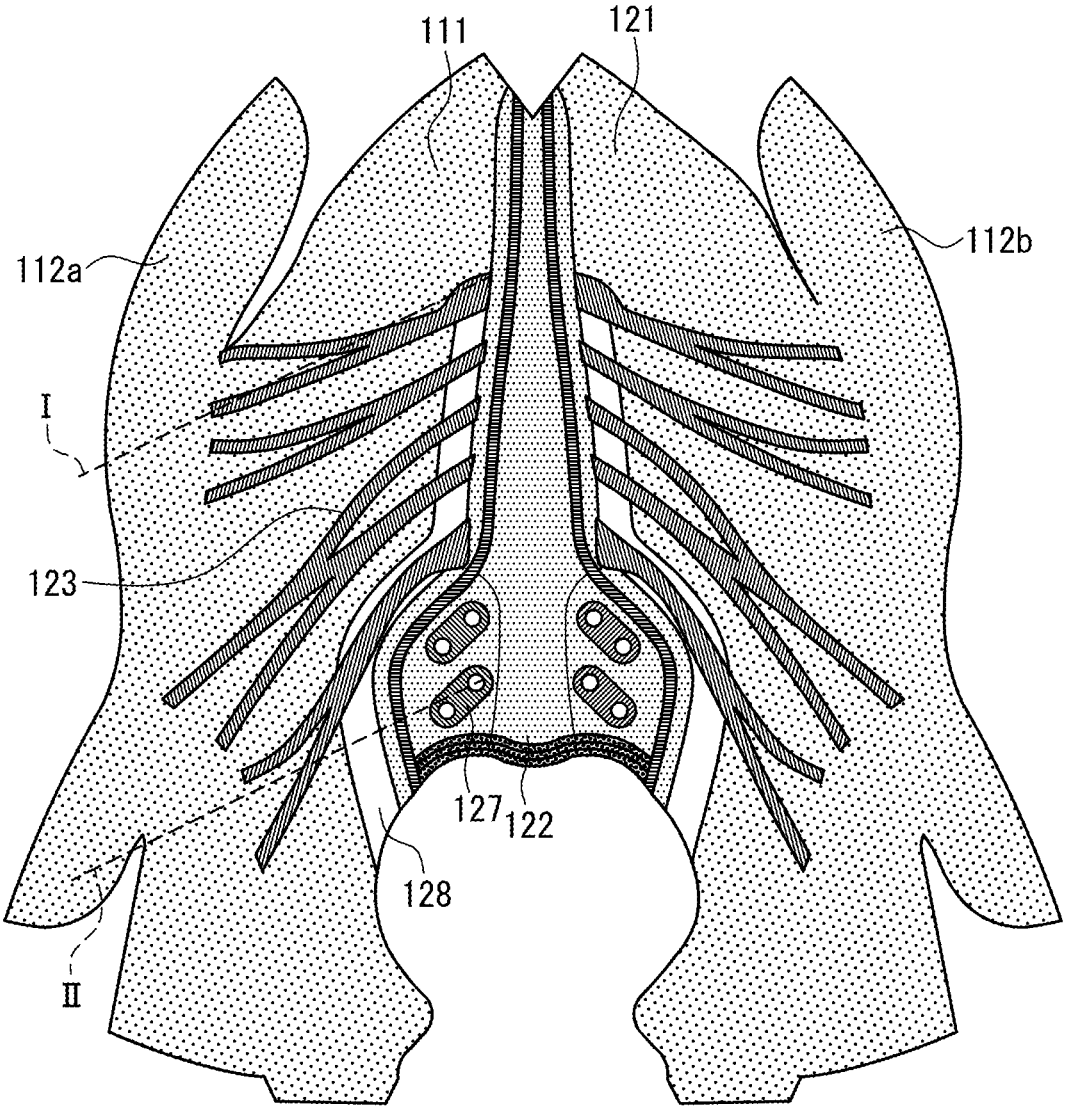
FIG. 9 is a schematic developed view illustrating the back side of an upper of the shoe (which faces the foot).
Figure 10:
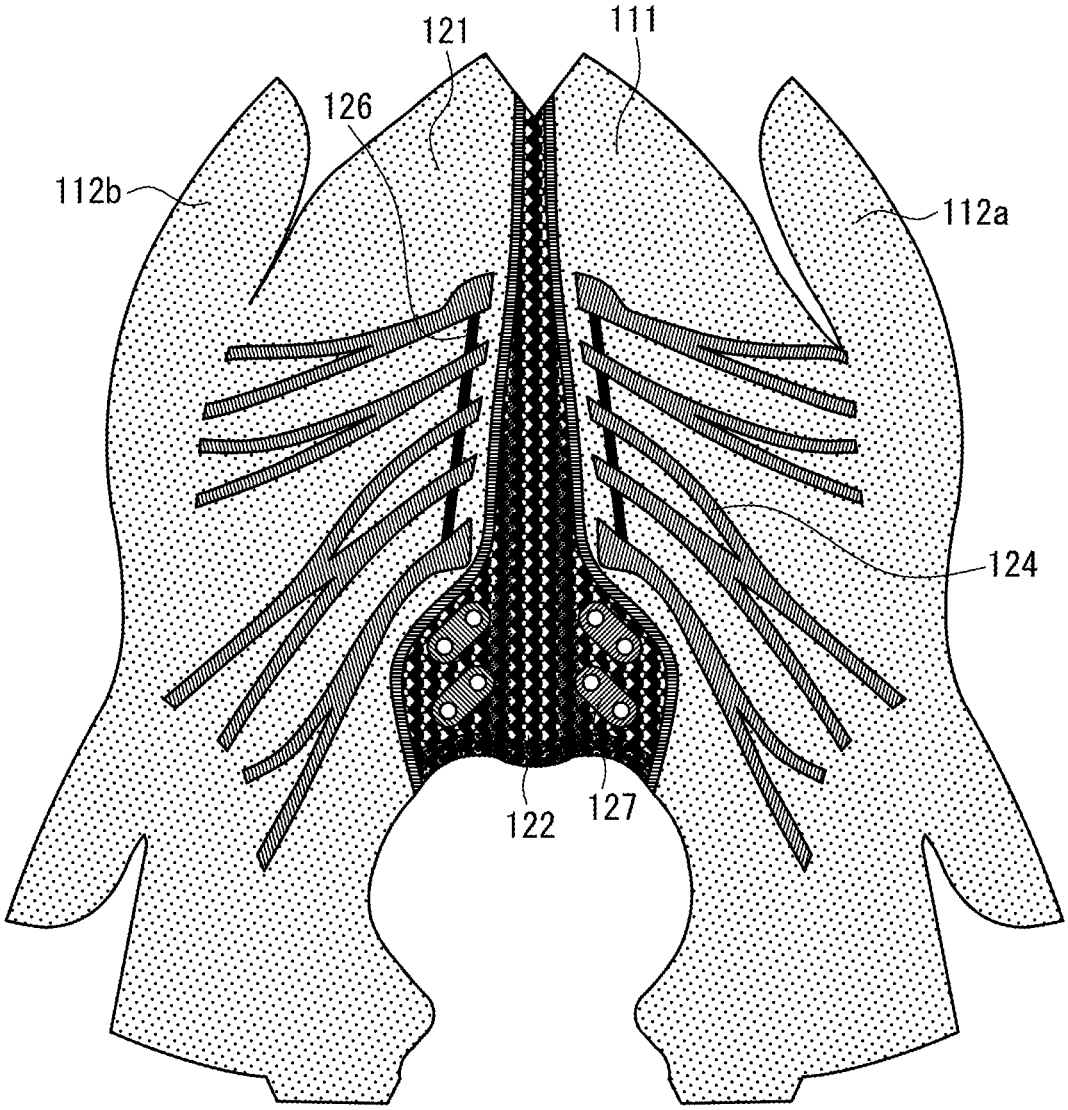
FIG. 10 is a schematic developed view illustrating the front side of the upper of the shoe (which faces away from the foot).
Figure 11:
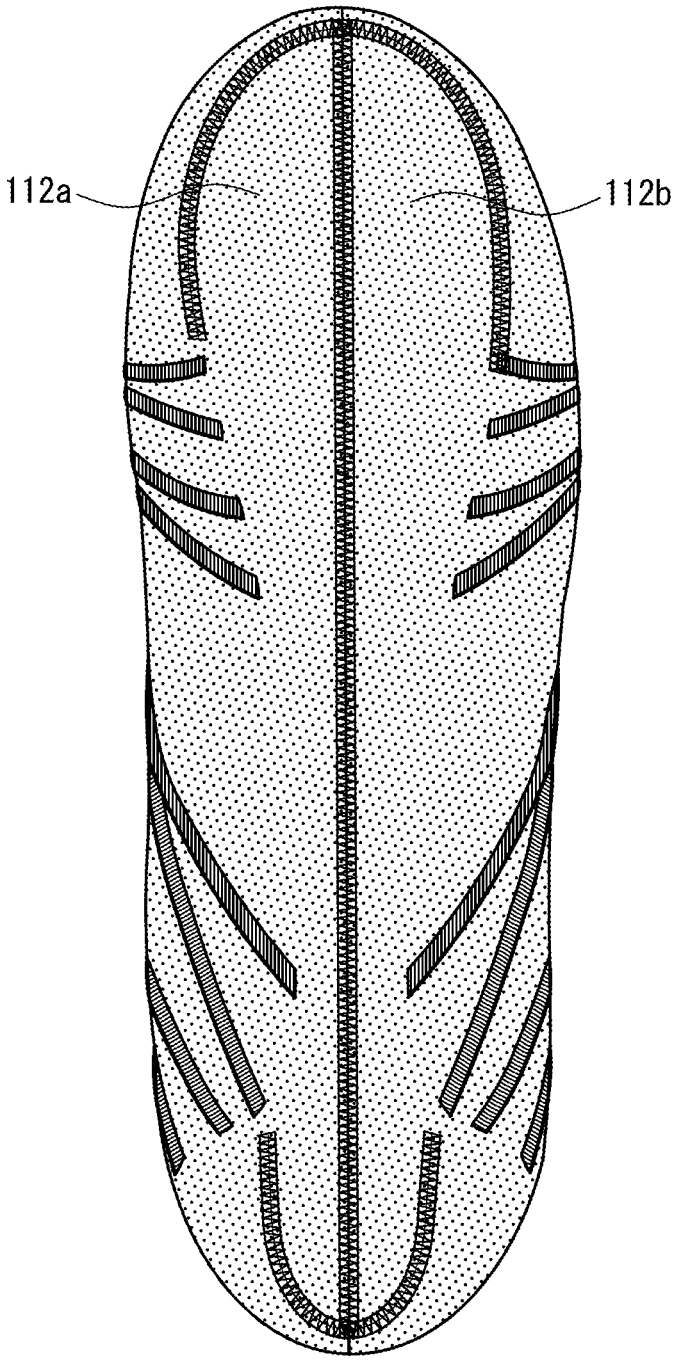
FIG. 11 is a schematic plan view illustrating the surface of the upper that comes into contact with a sole.

FIG. 8 is a schematic perspective view of a shoe (left foot) of an embodiment of the present invention. FIG. 9 is a schematic developed view illustrating the back side of an upper of the shoe (which faces the foot). FIG. 10 is a schematic developed view illustrating the front side of the upper of the shoe (which faces away from the foot). FIG. 11 is a schematic plan view illustrating the surface of the upper that comes into contact with a sole. In this embodiment, a shoe 100 includes an upper 110 and a sole 120 to which the upper 110 is attached. Moreover, the shoe 100 includes a toe reinforcement 130 and a heel counter 140.

The upper 110 includes an instep cover 111 and a sole cover 112. The inner sole cover 112*a* and the outer sole cover 112*b* are put together by sewing. The presence of the sole cover 112 further enhances the integration of the upper and the sole of the shoe, resulting in better fitting properties.

The instep cover 111 includes an instep cover body 121 and a tongue 122. The instep cover body 121 and the tongue 122 are joined to form a single unit. Thus, the contact between the foot and the shoe becomes comfortable, and the fitting properties and the long-term wearability are improved. The instep cover body 121 and the tongue 122 are joined as a single unit with the embroidery that covers the edge of the instep cover body 121.

The tongue 122 may be made of, e.g., a single raschel fabric. The single raschel fabric contains 5 to 15% by mass of elastic fibers (elastic yarns) and 85 to 95% by mass of non-elastic fibers (non-elastic yarns), has a weight per unit area of 300 g/m$^2$ or more and 550 g/m$^2$ or less, and has a thickness of 1 mm or more and 5 mm or less. The tongue 122 is disposed so that the longitudinal direction of the elastic fibers (elastic yarns) is oriented along the width direction of the foot. The elastic yarns may be, e.g., spandex yarns (monofilament, 140 dtex). The non-elastic yarns may be, e.g., polyester non-elastic yarns (multifilament, 48 filaments, 150 dtex).

A plurality of protrusions 123 are formed with embroidery on the side of the instep cover body 121 facing the foot. The embroidered protrusions 123 penetrate the instep cover body 121. Accordingly, a plurality of protrusions 124 corresponding to the protrusions 123, respectively, are formed on the opposite side of the instep cover body 121 from the foot. The protrusions 123 facing the foot are located at least in a region between the MP joint and the talus in a side portion of the instep cover body 121. The protrusions 123 have a height of 0.5 mm or more, a width of 2 mm or more, and a length of 2 mm or more. The protrusions 124 on the opposite side may have a height of 0.5 mm or more, a width of 2 mm or more, and a length of 2 mm or more. At least in the region between the MP joint and the talus in the side portion of the instep cover body 121, there is a portion in which a distance between each pair of the adjacent protrusions 123 is 2 mm or more.

The instep cover 111 also includes shoelace holes 126, 127 through which a shoelace 125 passes, and reinforcements 128 for the shoelace holes 126. The shoelace holes 126 of a predetermined size may be provided in such a way that strings or the like having a predetermined thickness are partially integrated with the instep cover body 121 by using the embroidery that forms the protrusions 124. The shoelace holes 127 may be formed by making holes of a predetermined size in the tongue 122 with embroidery.

The inner instep cover body 121 and the inner sole cover 112*a* are made of one piece of fabric. The outer instep cover body 121 and the outer sole cover 112*b* are made of one piece of fabric.

Figure 12:
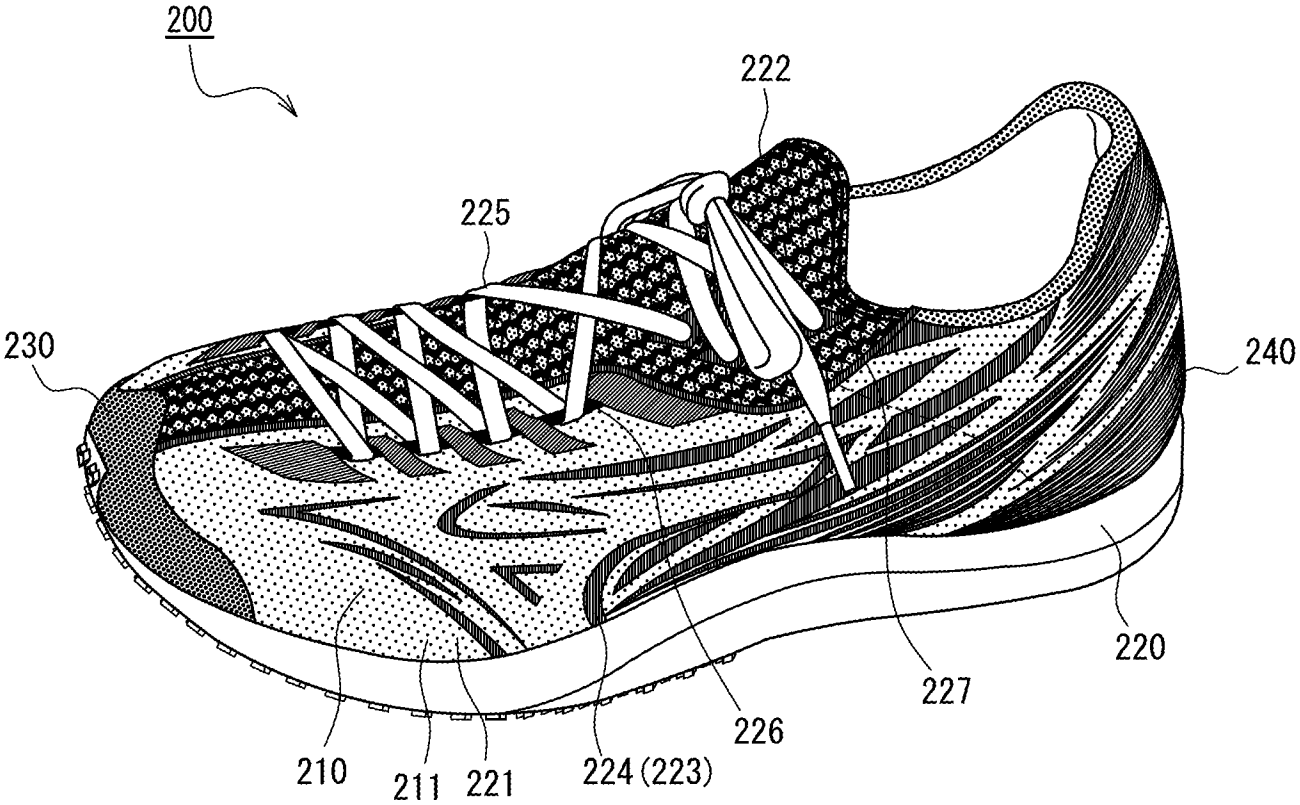
FIG. 12 is a schematic perspective view of a shoe (left foot) of an embodiment of the present invention.
Figure 13:
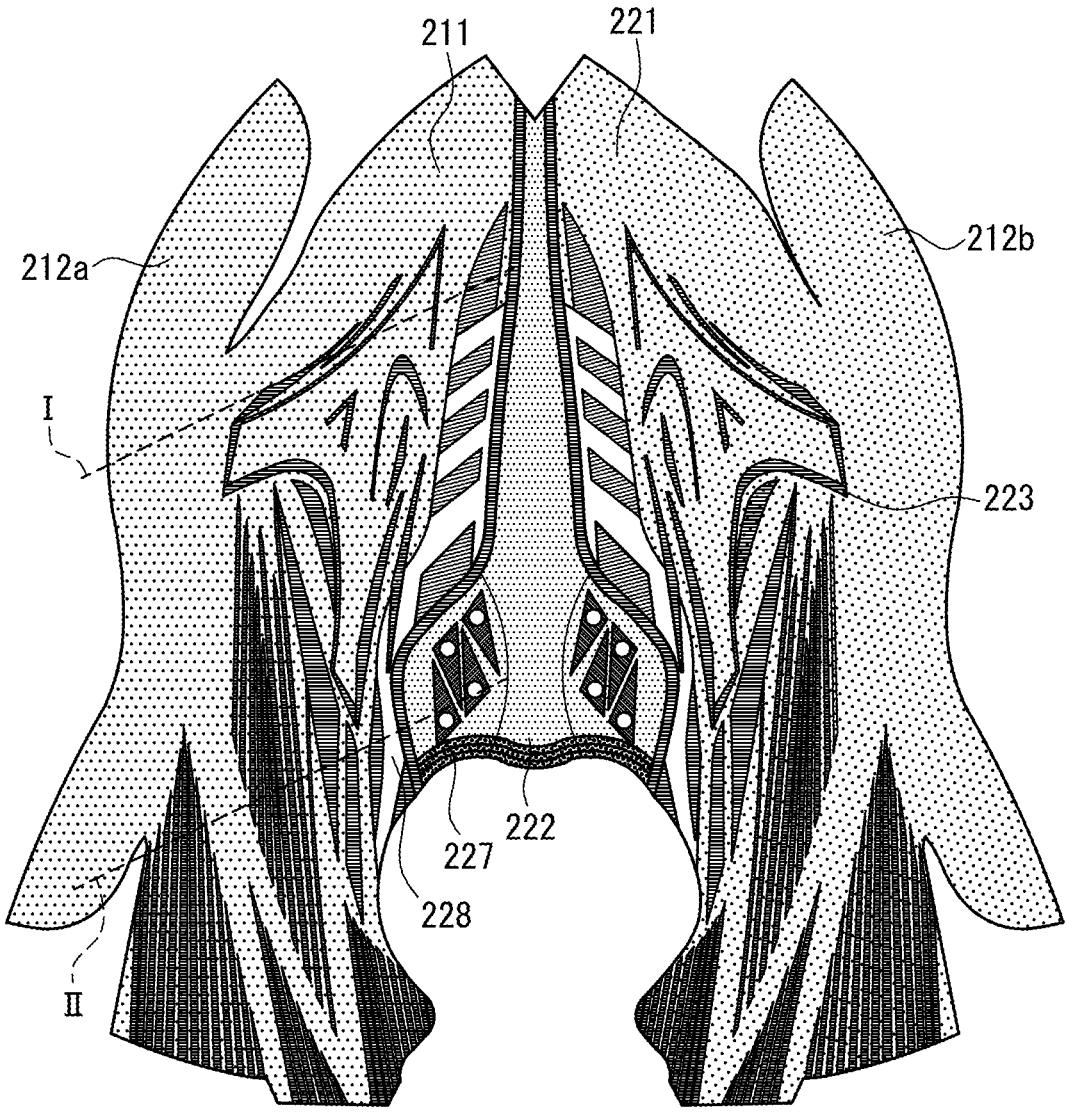
FIG. 13 is a schematic developed view illustrating the back side of an upper of the shoe (which faces the foot).
Figure 14:
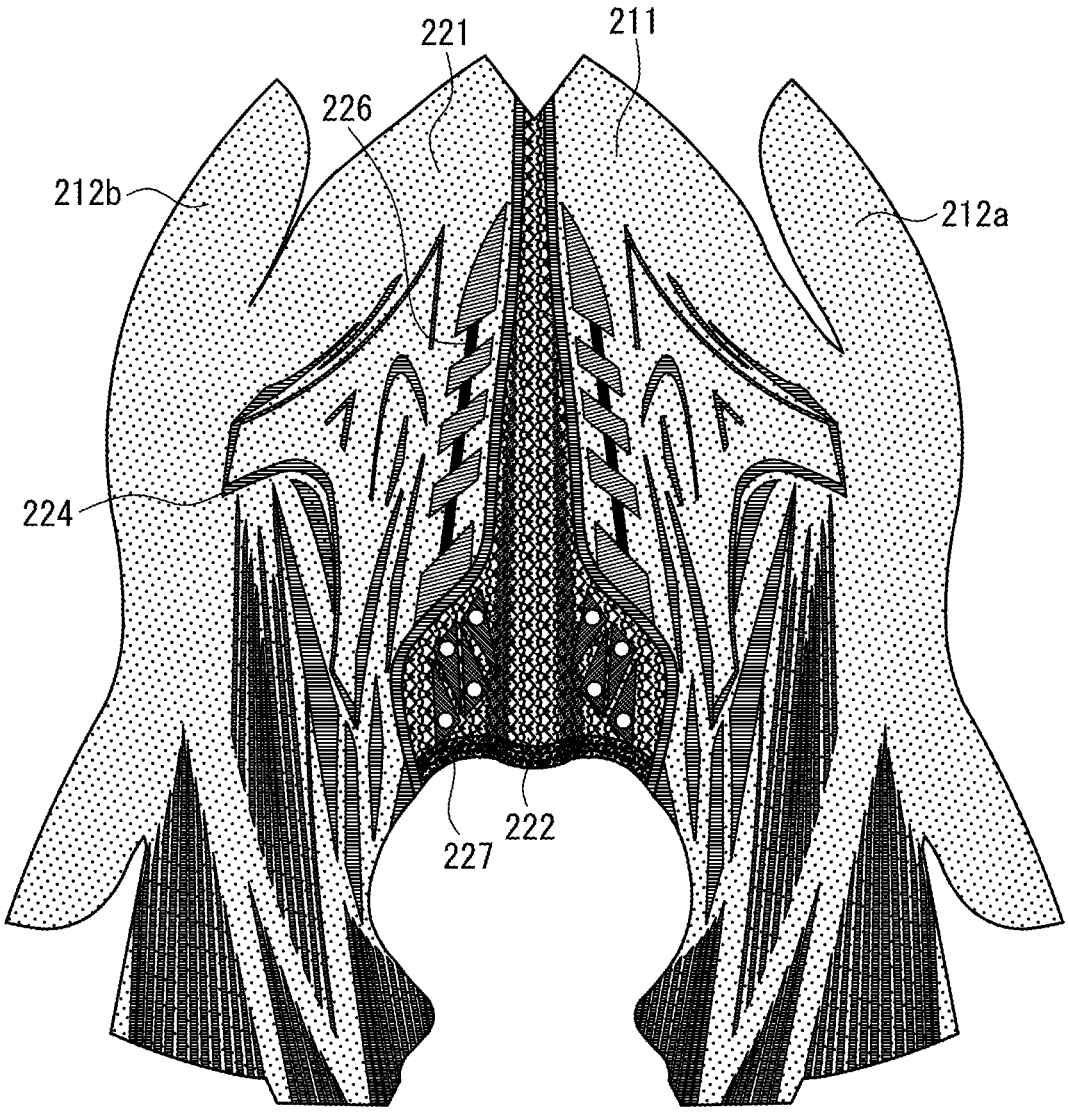
FIG. 14 is a schematic developed view illustrating the front side of the upper of the shoe (which faces away from the foot).
Figure 15:
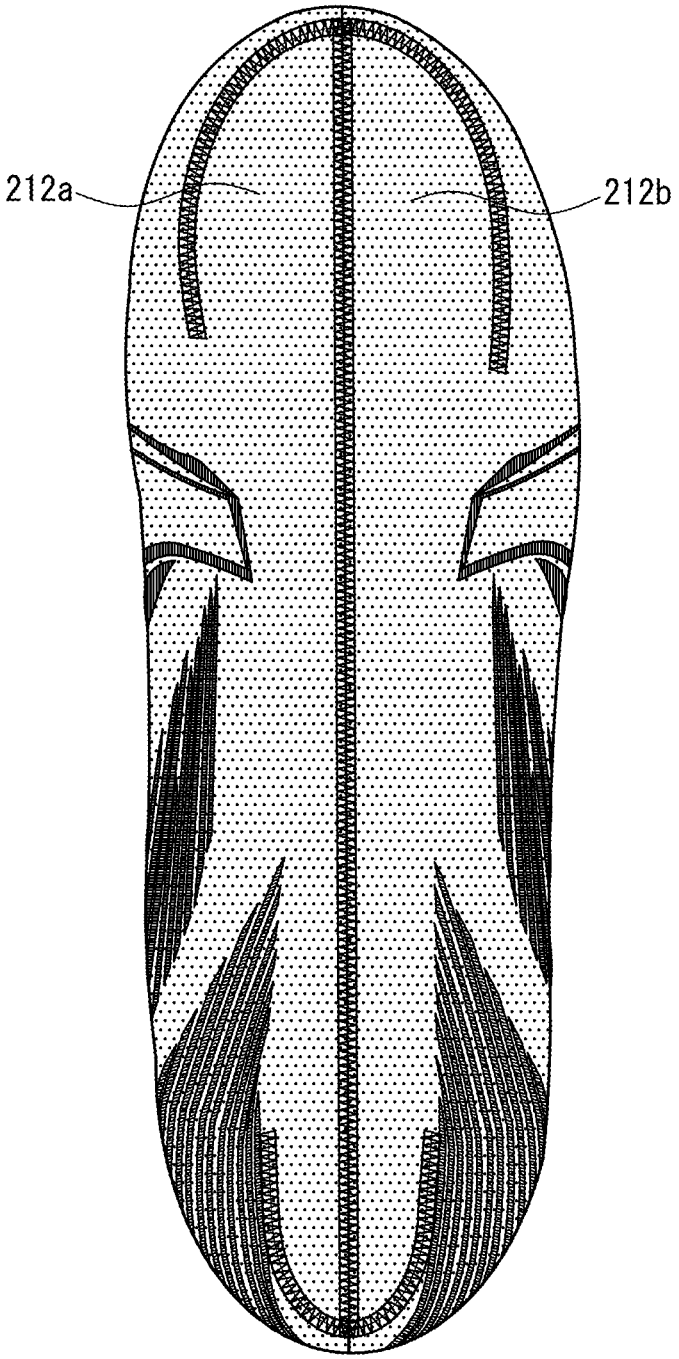
FIG. 15 is a schematic plan view illustrating the surface of the upper that comes into contact with a sole.

FIG. 12 is a schematic perspective view of a shoe (left foot) of an embodiment of the present invention. FIG. 13 is a schematic developed view illustrating the back side of an upper of the shoe (which faces the foot). FIG. 14 is a schematic developed view illustrating the front side of the upper of the shoe (which faces away from the foot). FIG. 15 is a schematic plan view illustrating the surface of the upper that comes into contact with a sole. In this embodiment, a shoe 200 includes an upper 210 and a sole 220 to which the upper 210 is attached. Moreover, the shoe 200 includes a toe reinforcement 230 and a heel counter 240.

The upper 210 includes an instep cover 211 and a sole cover 212. The inner sole cover 212*a* and the outer sole cover 212*b* are put together by sewing. The presence of the sole cover 212 further enhances the integration of the upper with the sole of the shoe, resulting in better fitting properties.

The instep cover 211 includes an instep cover body 221 and a tongue 222. The instep cover body 221 and the tongue 222 are joined to form a single unit. Thus, the contact between the foot and the shoe becomes comfortable, and the fitting properties and the long-term wearability are improved. The instep cover body 221 and the tongue 222 are joined as a single unit with the embroidery that covers the edge of the instep cover body 221.

The tongue 222 may be made of, e.g., a single raschel fabric. The single raschel fabric contains 5 to 15% by mass of elastic fibers (elastic yarns) and 85 to 95% by mass of non-elastic fibers (non-elastic yarns), has a weight per unit area of 300 g/m$^2$ or more and 550 g/m$^2$ or less, and has a thickness of 1 mm or more and 5 mm or less. The tongue 222 is disposed so that the longitudinal direction of the elastic fibers (elastic yarns) is oriented along the width direction of the foot. The elastic yarns may be, e.g., spandex yarns (monofilament, 140 dtex). The non-elastic yarns may be, e.g., polyester non-elastic yarns (multifilament, 48 filaments, 150 dtex).

A plurality of protrusions 223 are formed with embroidery on the side of the instep cover body 221 facing the foot. The embroidered protrusions 223 penetrate the instep cover body 221. Accordingly, a plurality of protrusions 224 corresponding to the protrusions 223, respectively, are formed on the opposite side of the instep cover body 221 from the foot. The protrusions 223 facing the foot are located at least in a region between the MP joint and the talus in a side portion of the instep cover body 221. The protrusions 223 have a height of 0.5 mm or more, a width of 2 mm or more, and a length of 2 mm or more. The protrusions 224 on the opposite side may have a height of 0.5 mm or more, a width of 2 mm or more, and a length of 2 mm or more. At least in the region between the MP joint and the talus in the side portion of the instep cover body 221, there is a portion in which a distance between each pair of the adjacent protrusions 223 is 2 mm or more.

The instep cover 211 also includes shoelace holes 226, 227 through which a shoelace 225 passes, and reinforcements 228 for the shoelace holes 226. The shoelace holes 226 of a predetermined size may be provided in such a way that strings or the like having a predetermined thickness are partially integrated with the instep cover body 221 by using the embroidery that forms the protrusions 224. The shoelace holes 227 may be formed by making holes of a predetermined size in the tongue 222 with embroidery.

The inner instep cover body 221 and the inner sole cover 212*a* are made of one piece of fabric. The outer instep cover body 221 and the outer sole cover 212*b* are made of one piece of fabric.

The above embodiments are to be considered in all aspects as illustrative only and not limiting. Those skilled in the art to which the present invention pertains would be able to make various embodiments using the principles of the present invention, without departing from the spirit and essential characteristics of the present invention, by taking the above teaching into consideration, even if there is no explicit description of such embodiments in the present specification.

EXAMPLES

Hereinafter, the present invention will be described in more derail by way of examples. The present invention is not limited to the following examples.

First, the measurement methods used in the examples will be described.

(Air Permeability)

The air permeability was measured in accordance with the Frazier method. The measuring device was an air permeability tester FX 3300 (manufactured by TEXTEST) and the measuring pressure was 125 MPa.

(Protrusions Facing Foot)

The height of the protrusions facing the foot was measured under no-load conditions. Specifically, a space between a test stand and the instep cover body was observed by a microscope (digital microscope VHX-100F), and the height of the space was measured and defined as the height of the protrusions facing the foot.

The width and length of the protrusions facing the foot and the distance between each pair of the adjacent protrusions were measured by a digital vernier caliper "ABS Solar Digimatic Caliper CD-S15CT (500-454)" manufactured by Mitutoyo Corporation. The measurement range was 0 to 150 mm.

The height, width, and length of the protrusions facing the foot and the distance between each pair of the adjacent protrusions were measured with the upper lying flat on the test stand before it was assembled to the sole.

(Area Ratio of Protrusions Facing Foot)

The total area Ta of the region between the MP joint and the talus in the side portion of the instep cover body was measured and calculated. Moreover, the total area Ca of the protrusions facing the foot in the above region between the MP joint and the talus was measured and calculated. Then, the area ratio of the protrusions facing the foot was determined by the following formula (1):

$$\text{Area ratio of protrusions facing foot (\%)} = Ca/Ta \times 100 \quad (1).$$

The area ratio of the protrusions facing the foot was measured with the upper lying flat on the test stand before it was assembled to the sole.

Example 1

Shoes having an upper structure shown in FIGS. 5 to 7 were produced. The instep cover body was made of a warp knitted fabric (single raschel fabric of 100% polyester, weight per unit area: 232 g/m$^2$, air permeability: 515 cc/cm$^2$/sec, major axis of through holes: 1.62 mm, minor axis of through holes: 1.09 mm, number of through holes: 146 per square inch). The tongue was made of a warp knitted fabric (double raschel fabric of 100% polyester, weight per unit area: 190 g/m$^2$). The embroidery thread was Sylco (product name, 100% polyester, fineness: 120 D) manufactured by Coats. Two types of embroidery stitches, i.e., a tatami stitch and a satin stitch were used. The weight of one shoe was 146 g.

In the instep cover body, the protrusion 24*a* had a height of 0.7 mm, a width of 2 mm, and a length of 5 to 56 mm, the protrusion 24*b* had a height of 0.65 mm, a width of 12 mm, and a length of 35 to 55 mm, and the protrusion 24*c* had a height of 0.7 mm, a width of 2 mm, and a length of 25 to 35 mm. In the region between the MP joint and the talus in the side portion of the instep cover body, the distance between each pair of the adjacent protrusions was 3 to 9 mm, and the area ratio of the protrusions facing the foot was 49%. Moreover, in the region between the MP joint and the talus in the side portion of the instep cover body, the air permeability of the portion including the protrusions facing the foot was 117 cc/cm$^2$/sec. In FIG. 6, the portion indicated by the broken line I and the broken line II corresponds to the region between the MP joint and the talus in the side portion of the instep cover body.

Example 2

Shoes shown in FIGS. 8 to 11 were produced. The instep cover body and the sole cover were made of a warp knitted fabric (single raschel fabric of 100% polyester, weight per unit area: 232 g/m$^2$, air permeability: 515 cc/cm$^2$/sec, major axis of through holes: 1.62 mm, minor axis of through holes: 1.09 mm, number of through holes: 146 per square inch). The tongue was made of a warp knitted fabric (double raschel fabric of 90% polyester and 10% spandex, weight per unit area: 402 g/m$^2$). The embroidery thread was Sylco (product name, 100% polyester, fineness: 120 D) manufactured by Coats. Two types of embroidery stitches, i.e., a tatami stitch and a satin stitch were used. The weight of one shoe was 177 g.

In the instep cover body, the protrusions 123 had a height of 0.9 mm, a width of 2 to 8 mm, and a length of 40 to 70 mm. In the region between the MP joint and the talus in the side portion of the instep cover body, the distance between each pair of the adjacent protrusions was 2 to 13 mm, and the area ratio of the protrusions facing the foot was 30%. In FIG. 9, the portion indicated by the broken line I and the broken line II corresponds to the region between the MP joint and the talus in the side portion of the instep cover body.

Example 3

Shoes shown in FIGS. 12 to 15 were produced. The instep cover body and the sole cover were made of a warp knitted fabric (single raschel fabric of 100% polyester, weight per unit area: 232 g/m$^2$, air permeability: 515 cc/cm$^2$/sec, major axis of through holes: 1.62 mm, minor axis of through holes: 1.09 mm, number of through holes: 146 per square inch). The tongue was made of a warp knitted fabric (double raschel fabric of 90% polyester and 10% spandex, weight per unit area: 402 g/m$^2$). The embroidery thread was Sylco (product name, 100% polyester, fineness: 120 D) manufactured by Coats. Two types of embroidery stitches, i.e., a tatami stitch and a satin stitch were used. The weight of one shoe was 171 g.

In the instep cover body, the protrusions 223 had a height of 0.7 to 0.9 mm, a width of 2 to 9 mm, and a length of 13 to 77 mm. In the region between the MP joint and the talus in the side portion of the instep cover body, the distance between each pair of the adjacent protrusions was 2 to 15 mm, and the area ratio of the protrusions facing the foot was 37%. In FIG. 13, the portion indicated by the broken line I and the broken line II corresponds to the region between the MP joint and the talus in the side portion of the instep cover body.

Fifty-nine subjects wore the shoes of Examples 1 to 3 and conventional running shoes without embroidery (reference example), and did high-intensity exercise (consisting of 1 km interval (3'00" to 3'10") and 10 to 20 km running (3'10" to 3'30")). Then, the breathability, the contact between the foot and the shoe, and the development of blisters and swelling were evaluated based on the following criteria. Table 1 shows the results.

(Breathability)

The breathability of the shoes was rated on a four-point scale A to D. Interviews with the individual subjects were conducted to know which grade accounted for the highest percentage.

A: The shoes had particularly good breathability.

B: The shoes had good breathability.

C: The shoes had breathability.

D: The shoes appeared to be less breathable, or had poor breathability.

(Contact Between Foot and Shoe)

The contact between the foot and the shoe was rated on a two-point scale A to B. Interviews with the individual subjects were conducted to know which grade accounted for the highest percentage.

A: The contact between the foot and the shoe was good.

B: The contact between the foot and the shoe appeared to be less comfortable, or was bad.

(Development of Blisters and Swelling)

When the number of subjects who got blisters or swelling on their feet was less than three, the shoes were rated A. When three or more subjects got blisters or swelling on their feet, the shoes were rated B.

TABLE 1

| | Examples | | | Reference Example (running shoes |
|---|---|---|---|---|
| | 1 | 2 | 3 | without embroidery) |
| Area ratio of protrusions facing foot | 49% | 30% | 37% | 0% |
| Breathability | C | A | B | D |
| Contact between foot and shoe | A | A | A | A |
| Development of blisters and swelling | A | A | A | B |

As can be seen from Table 1, each pair of shoes in Examples 1 to 3, which includes the protrusions facing the foot, has better breathability and is less likely to cause blisters and swelling, compared to the pair of shoes in Reference Example, which does not include any protrusions facing the foot. The reasons for this may be that the creation of the space between the foot and the upper due to the presence of the protrusions can improve the breathability of the shoes of Examples 1 to 3, and that stuffiness in the shoes can be reduced so that blisters and swelling are not likely to develop.

Table 1 also shows that despite the presence of the protrusions facing the foot, the contact between the foot and the shoe for each pair of shoes in Examples 1 to 3 is comparable to that for the running shoes without embroidery. The reason for this may be that the protrusions facing the foot are made of embroidery.

INDUSTRIAL APPLICABILITY

The shoes of one or more embodiments of the present invention can suitably be used for both daily life and exercise.

DESCRIPTION OF REFERENCE NUMERALS

1 MP joint
2 Talus
3, 22, 121, 221 Instep cover body
4, 24*a*, 24*b*, 24*c*, 123, 223 Protrusions facing foot
5 Foot
6 Space created between foot and instep cover body
10, 100, 200 Shoe
20, 110, 210 Upper
21, 111, 211 Instep cover
25*a*, 25*b*, 25*c*, 124, 224 Protrusions on opposite side
23, 122, 222 Tongue
26, 125, 225 Shoelace
27, 126, 127, 226, 227 Shoelace hole
30, 120, 220 Sole
40, 130, 230 Toe reinforcement
50, 140, 240 Heel counter
112, 212 Sole cover
112*a*, 212*a* Inner sole cover
112*b*, 212*b* Outer sole cover
128, 228 Reinforcement

What is claimed is:

1. A shoe comprising:

an upper comprising:

an instep cover that covers the instep of a foot, wherein the instep cover consists of an instep cover body and a tongue, and the instep cover body consists of a single layer of one piece of fabric having first and second opposed faces, with the first face defining an innermost surface of the instep cover body and the second face defining an outermost surface of the instep cover body; and two or more protrusions that are configured to extend in use from the instep cover body toward the foot and are located at least in a region between the MP joint and the talus in a side portion of the instep cover body, wherein the protrusions are made of embroidery on the single layer of one piece of fabric, the protrusions have a height of 0.5 mm or more, a width of 2 mm or more, and a length of 2 mm or more, and a distance between each pair of adjacent protrusions is 2 mm or more in part of the region.

2. The shoe according to claim 1, wherein an area ratio of the protrusions in the region between the MP joint and the talus in the side portion of the instep cover body is 1% or more and 50% or less.

3. The shoe according to claim 1, wherein an air permeability of a portion including the protrusions in the region between the MP joint and the talus in the side portion of the instep cover body is 110 $cc/cm^2/sec$ or more, as measured in accordance with a Frazier method.

4. The shoe according to claim 1, wherein the one piece of fabric of the instep cover body is a mesh fabric.

5. The shoe according to claim 1, wherein the upper is attached to a sole.

6. The shoe according to claim 1, wherein the protrusions have a height of 10 mm or less.

7. The shoe according to claim 1, wherein the protrusions have a width of 4 mm or more and 30 mm or less.

8. The shoe according to claim 1, wherein the protrusions have a length of 80 mm or less.

9. The shoe according to claim 1, wherein the distance between each pair of the adjacent protrusions is 3 mm or more and 20 mm or less in part of the region.

10. The shoe according to claim 1, wherein the protrusions have a height of 0.7 mm or more and 10 mm or less.

11. The shoe according to claim 4, wherein the mesh fabric is one selected from the group consisting of a warp knitted fabric, a plain knitted fabric, and a circular knitted fabric.

12. The shoe according to claim 11, wherein the warp knitted fabric is one selected from the group consisting of a single raschel fabric, a double raschel fabric, and a tricot fabric.

* * * * *